US005806696A

United States Patent [19]

Hytonen

[11] Patent Number: 5,806,696

[45] Date of Patent: Sep. 15, 1998

[54] METHOD AND EQUIPMENT FOR CONTROLLING THE OPERATIONS OF A CRANE

[76] Inventor: Kimmo Hytonen, Nauriskaski 2DF, Espoo, 02340, Finland

[21] Appl. No.: 905,315

[22] Filed: Aug. 4, 1997

Related U.S. Application Data

[63] Continuation-in-part of Ser. No. 500,880, filed as PCT/FI94/00043 Jan. 31, 1994, abandoned.

[30] Foreign Application Priority Data

Feb. 1, 1993 [FI] Finland ..... 930430

[51] Int. Cl.[6] ..... B66C 19/00

[52] U.S. Cl. ..... 212/270; 212/273; 212/274; 212/275; 212/316

[58] Field of Search ..... 212/270, 272, 212/273, 274, 275, 291, 316

[56] References Cited

U.S. PATENT DOCUMENTS

| | | | |
|---|---|---|---|
| 4,603,783 | 8/1986 | Tax et al. | 212/275 |
| 5,117,992 | 6/1992 | Simkus et al. | 212/275 |
| 5,490,601 | 2/1996 | Heissat et al. | 212/275 |

*Primary Examiner*—Thomas J. Brahan
*Attorney, Agent, or Firm*—Skinner and Associates; Joel D. Skinner, Jr.

[57] ABSTRACT

A method for controlling the motion of a crane lifting carriage, or trolley, a load suspended from it, a swing damping system, and/or an operator control cab whereby an ideal sequence of accelerations for moving the lifting carriage is defined that will bring the load to a swing-free condition at the end of the sequence of accelerations, and corresponding lifting carriage speed change signals are developed. A pendulum swing angle of the load corresponding with the ideal sequence of lifting carriage accelerations is calculated. The swing angle calculation and a geometric model of the swing damping system are used to determine a swing damping system control signal which makes the swing damping system follow the swing angle of the load. The lifting carriage speed change signal is applied to the traversing motor and the swing damping system control signal is applied to the swing damping equipment whereby the swing damping equipment allows the load to swing at the determined pendulum swing angle and damps only load swing that deviates from the determined pendulum swing angle. The swing angle calcualtion is also used to move the contol cab so that it follows the load movement rather than the lifting carriage movement.

10 Claims, 5 Drawing Sheets

METHOD AND EQUIPMENT FOR CONTROLLING THE OPERATIONS OF A CRANE

CROSS-REFERENCE TO RELATED APPLICATIONS

This application is a continuation in part of U.S. patent application Ser. No. 08/500,880, filed on Jul. 31, 1995, abandoned which is an application under 35 USC 371 of PCT International Application No. PCT/FI94/00043, filed Jan. 31, 1994, which claims priority of Finland Application No. 930430, filed Feb. 1, 1993.

STATEMENT REGARDING FEDERALLY SPONSORED RESEARCH OR DEVELOPMENT

Not applicable.

REFERENCE TO A MICROFICHE APPENDIX

Not Applicable.

BACKGROUND OF THE INVENTION

1. Field of the Invention

The present invention relates, generally, to methods of controlling an overhead crane. More particularly, the invention relates to an improved method for controlling the motion of a lifting carriage on an overhead crane and reducing undesired swing of a load suspended from it.

2. Background Information

To transfer items from one location to another with an overhead crane, it is desirable to minimize crane cycle time. This is especially important in the shipping industry where large amounts of cargo are transferred using cranes, and productivity can be hampered by long crane cycle times. Since a load to be transferred is suspended from a lifting carriage, or trolley, by long cables, the load swings like a pendulum when the lifting carriage is moved from one point to another. There can also be additional modes of sway which can couple with the pendulum swing. The load is typically not set down at its destination until all the sway stops or at least substantially settles. Substantial time and energy can be spent stopping undesirable sway of the load, which increases crane cycle time.

Undesirable pendulum sway of the load can be counteracted by movement of the lifting carriage and/or various damping equipment. It is well known that an ideal plan of crane and load movement can be defined as an optimum sequence of movements of crane parts and load which moves the load from a starting point to its destination in minimum time and where the load arrives at its destination in a steady condition. Methods and equipment used to control the movements of a crane's lifting carriage in an attempt to achieve such an ideal plan are known. The state of the art includes various devices and methods for controlling the motion of a crane and its suspended load.

Information contained in U.S. Pat. No. 3,517,830, for example, discloses a method of controlling a crane lifting carriage to minimize sway by synchronizing the lifting carriage motion and load swing such that each change of lifting carriage acceleration is automatically succeeded by an equal change in acceleration in the same direction after ½ of the resulting oscillation period of the load. The oscillation period T in seconds is calculated as:

$$T = 2\pi\sqrt{L/g}$$

where L=the distance from the center of gravity of the load to the fulcrum and g=the acceleration of gravity. U.S. Pat. No. 3,921,818, discloses a more complicated mathematical formula for determining the optimum acceleration and deceleration of a crane lifting carriage and applies a similar two step acceleration and deceleration process. It also discloses additional devices which measure and feed back the lifting carriage motor speed and cable swing angle to a controller. U.S. Pat. No. 4,756,432 discloses a method of controlling a crane lifting carriage which measures the weight of the lifting carriage, the weight of the load, and the length of the cables, then determines appropriate lifting carriage acceleration subperiods and an acceleration pause period. Lifting carriage motion is controlled by turning on and off a predetermined accelerating and decelerating force, which is activated by turning on and off the limit current value of the armature current through the lifting carriage motor.

To minimize the crane cycle time, the above systems should use the maximum acceleration and maximum velocity capabilities of the lifting carriage. Doing this results in a so called "bang-bang" type control. "Bang bang" refers to speed control where the maximum forward or reverse speed reference is called for by the operator. Through this control process, the lifting carriage is accelerated at the maximum rate for a short duration then continues at a steady speed for a time equivalent to half the pendulum period. The lifting carriage is then accelerated again up to its maximum lifting carriage velocity. Ideally, at this time the load is underneath the lifting carriage with no residual sway. The lifting carriage then continues to a point where the reverse of this acceleration process occurs. The lifting carriage is decelerated down to a point where a steady velocity, half that of maximum, is attained. Then another short period of deceleration and the load theoretically arrives at its destination with no residual sway.

These devices and methods are believed to have significant limitations and shortcomings. Specifically, there are a number of non linearities related to cable stretch, hoist cable length changes, structural deflections, and cable cantenaries which result in real loads arriving at their destinations with residual sway. Many of these errors can be corrected using closed loop feedback systems, but closed loop feedback systems can require fine tuning to achieve intended results, otherwise the overall system is slowed considerably below that of a minimum time system.

All the above systems base the ideal plan of crane and load motion on a mathematical model. Another way of obtaining an ideal plan, or at least one closely approximating it, is to use an expert operator to train an electronic controller which runs a crane. This system provides data on motor speed and hoist cable angle to a computer along with any crane operation signals given by the operator. In a "learn" mode, the operator moves the load from start to destination and the computer records the data and signals from the lifting carriage and hoist master switches. The computer then computes a quality index consisting of a combination of time and residual sway. Each time the operator makes this same path, it compares the quality index against the previously stored best path. If the new one is better than the old, the new one is stored. If it is not as good as the previous best path, it is discarded and the old one retained. In this way expert human operators can be used to achieve the ideal plan of crane movement. When an operator calls for an "auto"

cycle, the computer replays the best path signals taking the load from start to destination.

In all these systems, the movement of the crane's lifting carriage is controlled by adjusting the revolutions of the motor that moves the lifting carriage, with the result that the swing of the load suspended from the crane is minimized. In these systems, the control method is based on mathematical models of the load's swing, and time-based accelerations of the lifting carriage. The actual movements of the load are not measured at all. Therefore, these systems do not always work satisfactorily in all circumstances. For example, a sudden gust of wind may cause load swing that cannot be noticed or taken into account by a swing damping system that is based on this kind of control method.

Another approach to making the load arrive at its destination with no sway is to damp the sway in transit. Various methods of mechanically damping the swing of the crane's load are also known. These methods are generally based either on hydraulic dampers and/or diagonal cable suspension. U.S. Pat. No. 4,531,647, discloses such a system. U.S. Pat. No. 4,842,150 discloses guide cables wound on drums, the cables diverging to form a pyramid shape, and a horizontal girder with two diverging hydraulic cylinders which together form a triangle. U.S. Pat. No. 4,883,184 discloses a lifting platform suspended by six cables and a device to rotate the load in three axes to position it relative to the center of mass of the lifting platform. U.S. Pat. No. 4,747,745 discloses a load lifting frame suspended from the crane's trolley, the load lifting frame being stabilized against sway by a stabilizing beam actively engagable with the load lifting frame. U.S. Pat. No. 4,784,420 discloses an arrangement of ropes and pulleys with the ropes attached to both ends of two levers and a damping device interconnected between the two levers.

The objective of these systems is to damp load swing caused by the movements of the crane's lifting carriage completely and as rapidly as possible. The problems related to these mechanical damping systems include interruptive load swing, which results from the mechanical damping, and the technical complexity of the damping system, which is reflected in high prices and maintenance costs. As loads transferred by container cranes are very large, typically about 55 tons for example, a considerable amount of energy, well over 10 kW, is needed to damp the swing.

U.S. Pat. No. 5,219,420 discloses a method of controlling the trolley motion wherein the instantaneous kinetic condition of the load is determined and the trolley is controlled to bring the load to a swing-free kinetic condition. The kinetic condition of the load is determined either by measuring the angle of deflection of the load and the angular velocity, or from the previous trolley acceleration sequences and the length of the hoisting rope. This method is used without any mechanical damping system. If the load swing angle is not measured, then without a way to damp sway induced from external sources, such as the wind, the system may still have sway at the end of its travel.

On large cranes, an operator control cabin is often separate from the lifting carriage and runs on a separate track. If the control cabin motion is matched with lifting carriage motion, the ride can be rather rough, especially as lifting carriages are run using a "bang-bang" type of operation. If the control cabin is left stationary, or run at a constant speed, the distance between the load and the operator can vary greatly making it more difficult to observe and control the load.

Applicant's invention provides an improved method of controlling the motion of a crane and its suspended load which overcomes the limitations and shortcomings of the known art. Accordingly, it is an object of the present invention to provide an improved method for controlling crane operation which provides lifting carriage motion according to a defined ideal plan for lifting carriage and load motion, and which allows pendulum motion of a load suspended from the lifting carriage according to that ideal plan, but which damps load swing which deviates from that ideal plan.

It is a further object of this invention to provide an improved method of controlling the movement of a control cabin when the control cabin is run on a track separate from the lifting carriage such that the control cabin is moved in accordance with the ideal plan of movement for the load thereby keeping the relative position of the control cabin to the load essentially unchanged in the direction of lifting carriage travel.

BRIEF SUMMARY OF THE INVENTION

The present invention provides an improved method for controlling the motion of a crane lifting carriage, or trolley, a load suspended from it, and a swing damping system connected to it whereby an ideal sequence of accelerations for moving the lifting carriage is defined that will bring the load to a swing-free condition at the end of the sequence of accelerations, and corresponding lifting carriage speed change signals are developed. A pendulum swing angle of the load corresponding with the ideal sequence of lifting carriage accelerations is calculated. The swing angle calculation and a geometric model of the swing damping system are used to determine a swing damping system control signal which makes the swing damping system follow the swing angle of the load. The lifting carriage speed change signal is applied to the traversing motor and the swing damping system control signal is applied to the swing damping equipment whereby the swing damping equipment allows the load to swing at the determined pendulum swing angle and damps only load swing that deviates from the determined pendulum swing angle.

The amount of damping required is considerably less than that required for known mechanical swing damping systems which attempt to damp the entire swing of the load. With the method of the invention it is possible to construct a mechanical swing damping system that is substantially lighter and simpler than those previously known, while still achieving a more effective overall swing damping system. At the same time, there is decreased wearing of the mechanical swing damping equipment and reduced maintenance costs.

Where the mechanical swing damping equipment includes swing damping cables, the swing damping control signal can adjust the length of the swing damping cables.

Where the mechanical swing damping equipment includes a hydraulic damping system, the swing damping control signal can adjust the damping induced by the hydraulic cylinders.

Where the mechanical swing damping equipment includes an electromechanical damping system, the swing damping control signal can adjust the damping induced by the electromechanical actuators.

Where the mechanical swing damping equipment is mounted on a pivoting beam supported by said lifting carriage, an actuator is attached between the beam and the lifting carriage. The beam is actively pivoted by motion of the actuator to match the load swing angle. The swing damping system control signal adjusts displacement of the actuator.

In an embodiment of the invention, where the trolley is operated on one track and the control cabin on another track, parallel to the first, the swing angle calculation is also used to control the crane's control cabin motion to follow the movements for the load so that the relative location of the control cabin and the load along the tracks is maintained essentially unchanged.

The features, benefits and objects of this invention will become clear to those skilled in the art by reference to the following description, claims and drawings.

DETAILED DESCRIPTION

Figure 1:
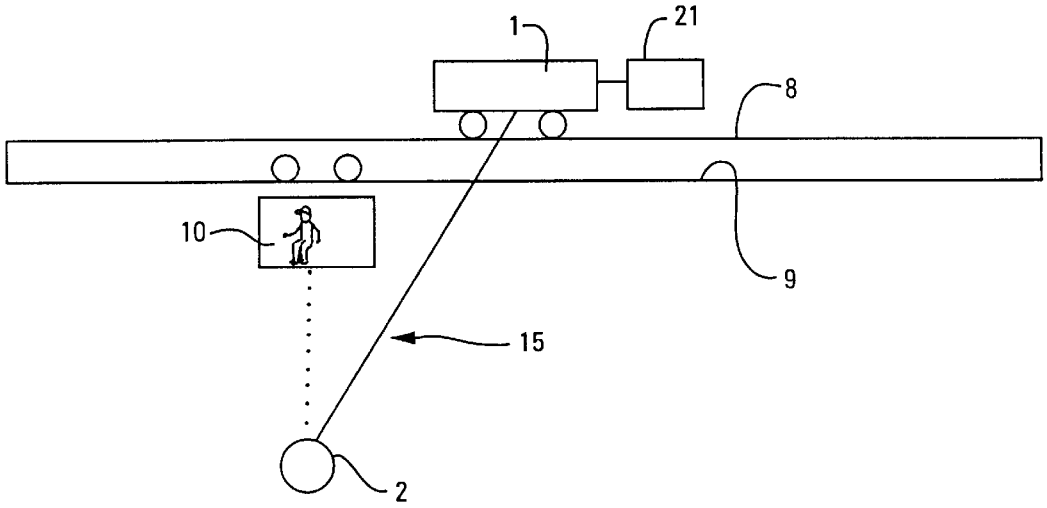
FIG. 1 is a schematic diagram of a crane arrangement to which the method and equipment according to the invention may be applied.
Figure 2:
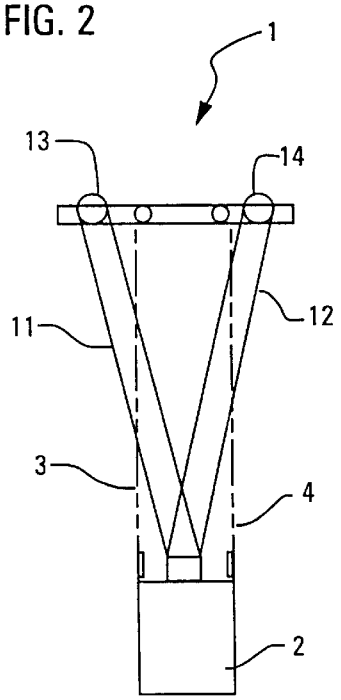
FIG. 2 is a schematic diagram of one type of mechanical swing damping equipment which can be controlled according to the invention.
Figure 3:
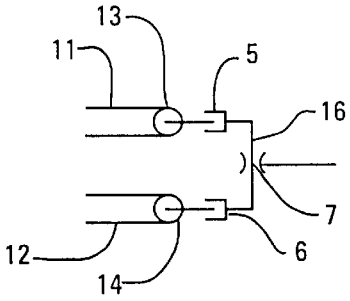
FIG. 3 is a schematic diagram the hydraulic part of another type of mechanical swing damping equipment which can be controlled according to the invention.

Referring to FIGS. 1–3 a crane arrangement is presented which comprises a lifting carriage or trolley 1 designed to move on the first track 8 and a control cabin 10 designed to move on the second track 9, parallel to the first track 8. The trolley, 1 carries the load 2 by means of the cable system 15. The crane arrangement also includes a control system 21 which controls the movements of the trolley 1 and any mechanical damping equipment, such as cables 3 and 4, or hydraulic dampers 5 and 6, on trolley 1 so as to minimize the undesired swing of the load 2. The control system may be, for example, a system as described in any of the referenced publications. The control system preferably includes a device which records trolley acceleration, and which can measure the length of the hoist rope, and determine the swing angle of the load and its angular velocity.

Figure 4:
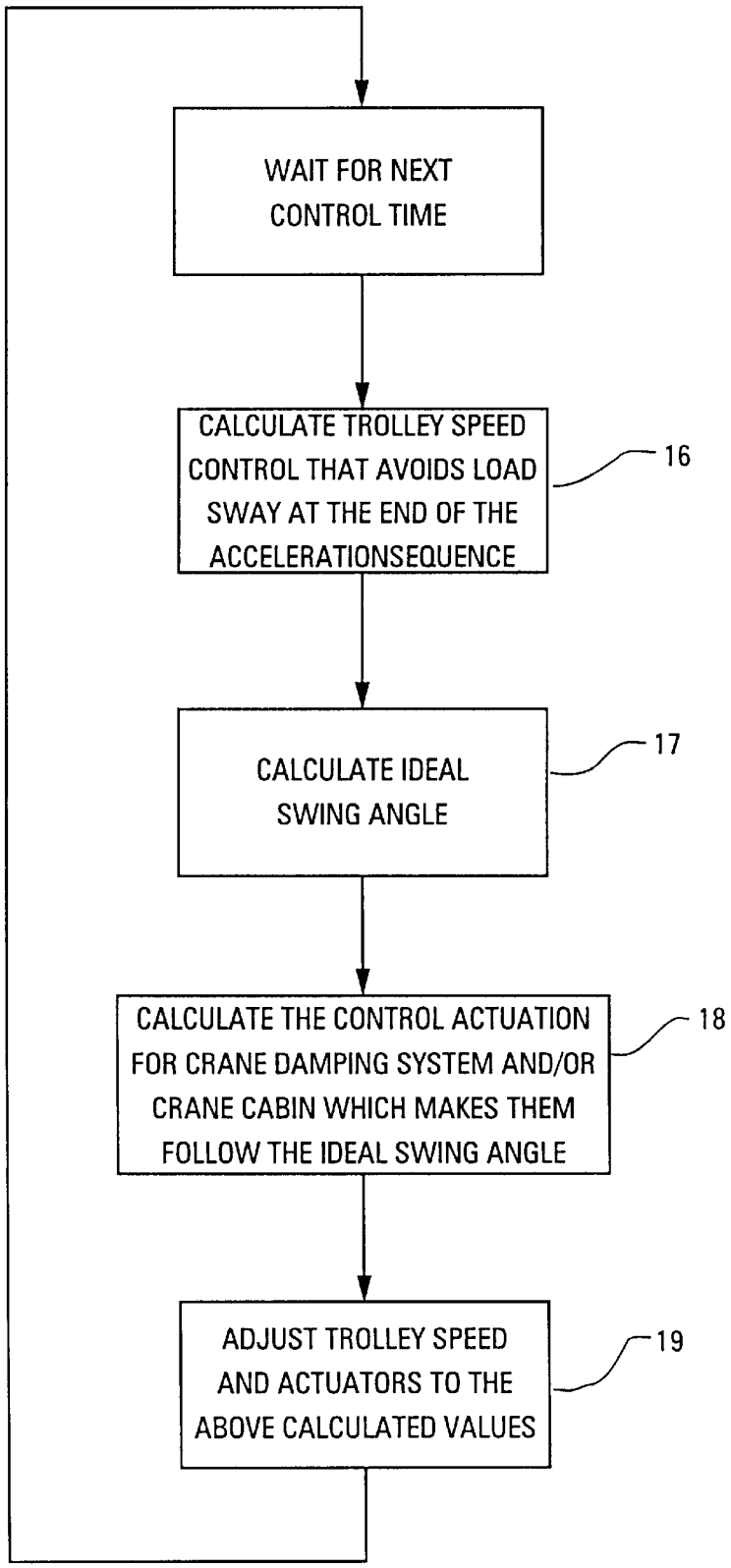
FIG. 4 is a flow diagram for a control system operating according to the invention.

Referring to FIG. 4, a flow diagram for a control system operating by the method of this invention is illustrated. For block 16, methods of calculating the trolley speed that avoids load sway at the end of the acceleration sequence are well known as referenced in the above U.S. patents. The preferred method of performing the function of block 16 is disclosed in U.S. Pat. No. 5,219,420, issued on Jun. 15, 1993. That patent discloses a method of determining the instantaneous kinetic condition of the load and controlling the trolley motion to bring the load to a swing-free kinetic condition. The above patent is hereby incorporated by reference. In that method, the kinetic condition of the load is determined either by measuring the angle of deflection of the load and the angular velocity, or from the previous trolley acceleration sequences and the length of the hoisting rope. Methods and devices to measure the hoist rope length are known in themselves. Trolley speed is then adjusted so as to bring the load to a swing-free condition at the end of a sequence of accelerations.

For block 17, the natural swing of the load 2 can be calculated from the well-known equations:

$$\theta = \frac{a}{g} - \frac{a}{g}\cos\left(2\pi\frac{t}{\tau}\right) \text{ and } \tau = 2\pi\sqrt{L/g}$$

where:

θ=load swing angle;
a=crane trolley acceleration
g=acceleration of gravity
L=length of pendulum
τ=pendulum period
t=time These equations cannot be solved in closed form when the pendulum length L is changing, such as when the load is being raised or lowered as the trolley is accelerated, but they can be solved by numeric methods. The method of U.S. Pat. No. 5,219,420 discloses a way of determining the period of oscillation, angle of deflection and oscillation velocity as functions of time whether the hoist rope length is constant or changing. That method also discloses a way of generating a control signal to the trolley motor. A control table of trolley accelerations and resulting corresponding ideal swing angles can be generated for control time increments.

An existing device which also controls speed of a crane trolley to produce no load sway is manufactured by P&H Material Handling of Milwaukee, Wis. under the trademark SWINGUARD. The Swinguard device reads the load height and speed reference for each control time and calculates a trolley speed for every control time so that after the control sequence is done, the trolley moves on the reference speed with no load sway. For block 16 the speed of the trolley for each control time can be obtained from a device such as the Swinguard device, and for every control time, a corresponding ideal load swing angle θ at the end of the control time can be calculated or determined for block 17 based on the equations above or on the method of U.S. Pat. No. 5,219,420.

In block 18, the calculated ideal swing angle is used to calculate the control action necessary for a damping system operating on trolley 1 so that those systems will follow the ideal swing angle. Since there are many types of damping systems used on cranes, the control action necessary for this step depends on the specific mechanisms used on the damping equipment. It may involve, for example, varying the speed of an electric motor, or adjusting the resistance of a hydraulic pressure relief valve, or moving a linear actuator. Some examples of how the invention is used with specific types of swing damping equipment are given below. By having a damping system follow the ideal swing angle the amount of damping required is considerably less than that required for known mechanical swing damping systems which attempt to damp the entire swing of the load. With the method of this invention, it is possible to construct a mechanical swing damping system that is substantially lighter and simpler than those previously known, while still achieving a more effective overall swing damping system. At the same time, there is decreased wearing of the mechanical swing damping equipment and reduced maintenance costs.

In block 18, the ideal load swing angle determination can also be used to control the motion of the crane control cabin 10 so it follows the load rather than the trolley. FIG. 1 shows that control cabin 10 is separate from lifting carriage 1. For control cabin 10 to move in such a way that the operator can follow the movements of load 2 as well as possible, the control cabin is moved so that the locations of control cabin 10 and the load 2 in the direction of tracks 8 and 9 are maintained essentially unchanged with respect to each other. If the control cabin 10 is moved independently of the trolley, the ideal swing angle calculation can be used to add or subtract compensating movements to a motor driving the control cabin. If the control cabin 10 is mechanically connected to the trolley 1, a linear actuator can be connected between the control cabin 10 and the trolley 1 and the actuator displacement determined from the ideal swing angle calculation. For small swing angles, if the linear actuator is oriented substantially horizontally, the displacement can be the swing angle multiplied by the pendulum length L. In practice it is possible with this method to have control cabin 10 remain above load 2 for example. The particular advantage with this method is that the control cabin does not move with the lifting carriage but with the swing of the load, which is a more gentle ride for the operator in terms of acceleration.

In block 19 control signals from the calculations in blocks 16 and 18 are given to the trolley motor and any actuators or other swing damping equipment to be controlled.

The system then repeats the loop at the next control time increment.

In conjunction with a device such as the Swinguard device or a device operating by the method of U.S. Pat. No. 5,219,420, the present invention uses the ideal load swing angle at every control time to control a damping system on a crane so as to allow natural pendulum swing but damp any other sway. All damping systems on cranes, such as those referenced above, can be represented by a geometric model which can be made to follow the ideal swing of the load.

Referring to FIG. 2, an example of some known equipment for the damping of the swing of a crane's load is presented. This equipment includes the bearing cables 11 and 12 drawn over idler wheels 13 and 14 and attached at both free ends to points on opposite sides of the load 2, so as to form the shape of a V between them. In addition, load 2 has swing damping cables 3 and 4 attached. The ideal swing angle is used to adjust the length of swing damping cables 3 and 4 as to match the ideal swing of the load and to damp only the swing that deviates from that. The means of adjusting the length of swing damping cables 3 and 4 is not, for reasons of clarity, presented in FIG. 2, but may be included in the control circuits of the motors driving the drums around which the cables are wound. The purpose is to lengthen and shorten the swing damping cables 3 and 4 so that they allow a residual swing arising from the ideal use of the trolley control system, but do not however allow other kinds of load swing. All interruptive swing, or swing caused by faulty operation of the trolley control system, which deviates from the ideal swing is damped. Thus the loading of these swing damping cables 3 and 4 is relatively small, compared with the situation where they would damp the entire swing of a freely swinging load.

Referring to FIG. 3, a second type of known mechanical swing damping system is presented in terms of its basic principle and which can be adapted to a load suspension system of FIG. 2. In this case the swing damping cables 3 and 4 can be omitted from the arrangement. According to the schematic presentation in FIG. 3, the idler wheels 13 and 14 of the load-bearing, crossed cables 11 and 12 are suspended from the piston drivers of the hydraulic cylinders 5 and 6. The cylinder spaces of these hydraulic cylinders 5 and 6 are in turn joined with a hydraulic hose 16, equipped with a pressure relief valve 7 for adjusting pressure. By adjusting this pressure relief valve 7, it is possible to control the damping behavior of the described hydraulic damping system. If the pressure relief in valve 7 is set at zero, there will be no damping effect at all. This situation occurs when the swing angle of the load corresponds to the ideal swing angle. In practice this means that the flow of hydraulic fluid in hose 16 is of a certain magnitude and direction corresponding with the ideal swing angle. If the rate or direction of flow of the hydraulic fluid deviates from this ideal situation, the pressure relief valve 7 is directed to limit the flow. Thus the hydraulic system is capable of damping the load swing that deviates from the ideal plan of movements achieved by the control system.

Electromechanical actuators can also act as mechanical swing damping equipment. An example of this kind of solution is a system in which the load is carried by a suspension cable which is drawn around an idler wheel at the load end. When the load swings, the idler wheel rotates around its axle. This rotation can be adjusted, for example, by an electric motor connected to the axle of the idler wheel, so that its operation is controlled with an electromechanical brake when the load swing deviates from the ideal load swing. In this case, braking moments must be used such that the suspension cable does not begin to slip with relation to the idler wheel.

Figure 5:
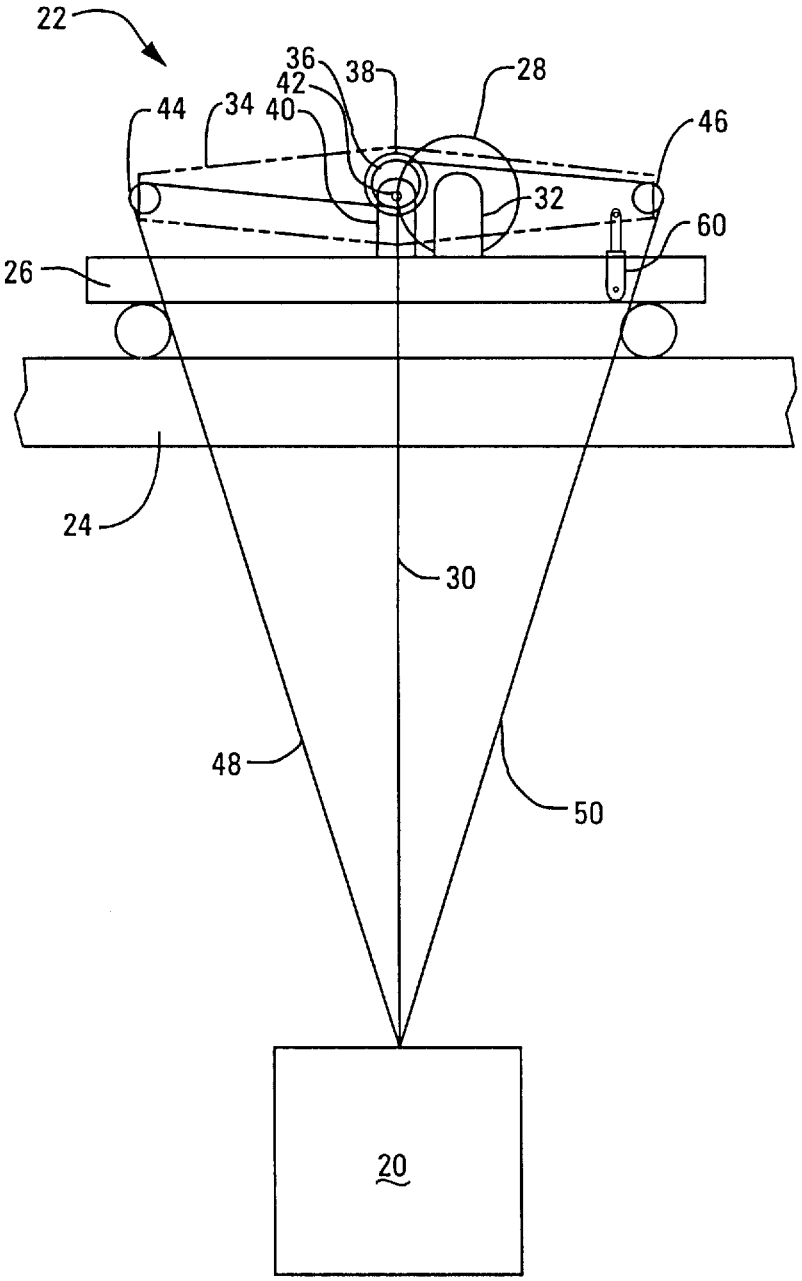
FIG. 5 is a schematic diagram a crane arrangement having a swing damping system which is pivotably driven by a linear actuator.
Figure 6:
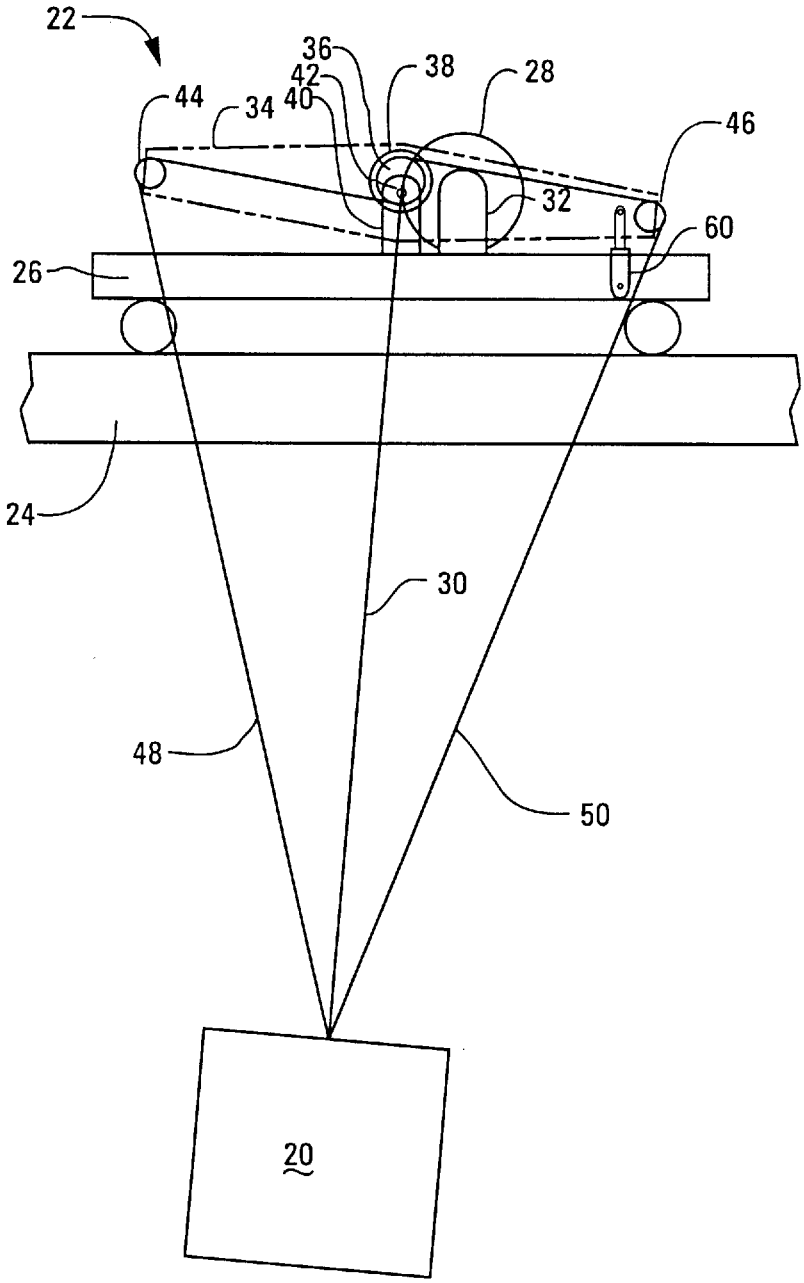
FIG. 6 a schematic diagram a crane arrangement of FIG. 5 shown when the load swings one direction.
Figure 7:
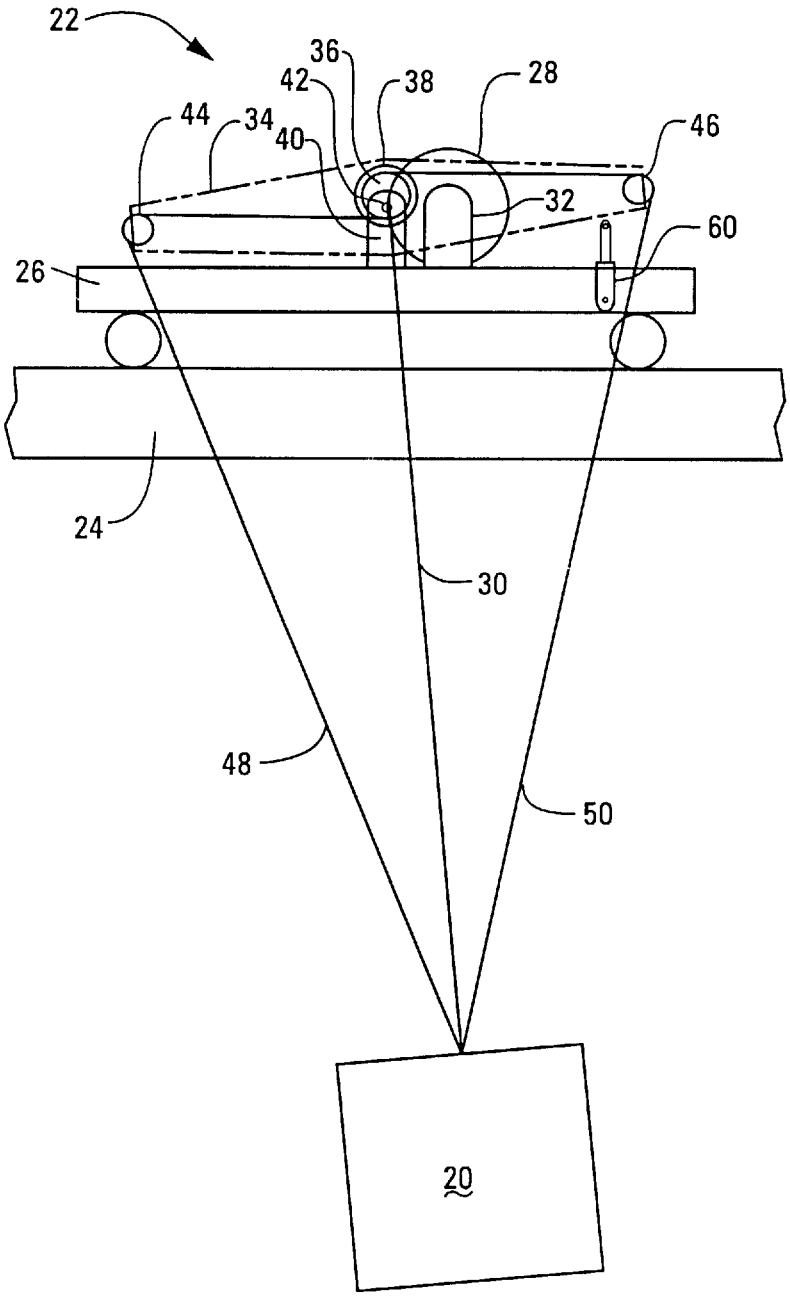
FIG. 7 a schematic diagram a crane arrangement of FIG. 5 shown when the load swings the opposite direction as in FIG. 6.

Each of the specific damping systems described above or in the reference patents would have to be modeled and the appropriate control executed on the system. Referring to FIGS. 5–7, another way of controlling a damping system by the present invention is to mount the entire damping system on a moveable member, such as a pivoting beam, and actively pivot it match the ideal load swing angle. This method could be used with the above described damping systems or with those of the previously referenced patents. FIGS. 5–7 schematically illustrate how this system operates.

Load 20 is moved by trolley assembly 22 on track 24. Trolley assembly 22 has a trolley carriage 26 supported by and in rolling engagement with track 24. A hoist 28 is supported on trolley 26 by support member 32. A hoist rope 30 extends downward from hoist 28 and attaches to load 20 thereby suspending load 20 from trolley assembly 22. Load 20 is raised and lowered by hoist 28, and load 20 is moved horizontally by carriage 26 being driven along track 24.

When carriage 26 is accelerated and decelerated, load 20 naturally sways on hoist rope 30. To control sway of load 20 an anti-sway system is attached to carriage 26. The anti sway system has a beam 34 pivotably supported by carriage 26 through pivot support member 40. Beam 34 pivots at pivot point 42, which preferably aligns with the location about which hoist rope 30 pivots. A drive pulley 36 is attached to beam 34 and is rotationally driven by a constant torque motor 38 connected to drive pulley 36. Pulleys 44 and 46 are attached to beam 34 at opposite ends of beam 34. One anti-sway rope 48 extends from load 20 around pulley 44 and onto drive pulley 36. Another anti-sway rope 50 extends from load 20 around pulley 46 and onto drive pulley 36. Attachment of ropes 48 and 50 to drive pulley 36 is such that rotation of drive pulley 36 in one direction, counter clockwise in this illustration, tensions both ropes. Alternatively, anti-sway ropes 48 and 50 may attach to separate pulleys driven be separate motors.

A linear actuator 60 is connected between carriage 26 and beam 34. Linear actuator 60 moves such to make beam 34 pivot at the same angle and at the same angular velocity during the time carriage 26 is accelerated as is calculated for the natural pendulum swing of load 20 on hoist rope 30. This keeps the lengths of anti-sway ropes 48 and 50 equal during ideal swing of load 20, and allows motor 38 working with ropes 48 and 50 to damp only sway other than the ideal swing of load 20. The desired displacement of linear actuator 60 for the same control time increments as for the trolley is calculated from the ideal load swing angle. This data is fed into a controller for linear actuator 60.

Referring to FIG. 6, as the load swings one direction, actuator 60 is retracted to properly pivot beam 34. Referring to FIG. 7, as the load swings the opposite direction, actuator 60 is extended to properly pivot beam 34.

In the case where two separate pulleys and drive motors are used for anti-sway ropes 48 and 50, the pivoting beam 34 and actuator 60 may not be needed. Instead, those drive motors may be rotated to lengthen and shorten ropes 48 and 50 to match the calculated ideal swing angle for load 20.

The above method for controlling a crane's operations, as well as the crane arrangements, are described only with the aid of some exemplary embodiments, and it is thus understandable that the invention may be fulfilled by arrangements differing from the foregoing without, however, departing from the protected area defined by the following claims, according to which a mechanical swing damping system is used to damp only that swing which deviates from the ideal swing arising from the controlled movements of the lifting carriage. Thus this mechanical swing damping system concerns nearly all known types of mechanical swing damping systems which can be modified according to the invention to limit only the swing that deviates from the ideal swing arising from the controlled movements of the lifting carriage. Mechanical swing damping systems are understood to mean all swing damping that is not based on the electrical control of the movements of the lifting carriage.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. A method for controlling the movement of an overhead crane, the crane having at least one track, a movable lifting carriage running on at least one track, a traversing motor for moving the lifting carriage along the track, a control system which controls the traversing motor based on at least one command signal representative of lifting carriage speed, at least one hoisting rope depending from the lifting carriage, a load attached to the at least one hoisting rope such that the load is suspended by and swings from the lifting carriage, mechanical swing damping equipment, and a control system which controls the mechanical swing damping equipment, the method comprising the steps of:

(a) defining an ideal sequence of accelerations for moving the lifting carriage that will bring the load to a swing-free condition at the end of the sequence of accelerations;

(b) developing a lifting carriage speed change signal which will bring the load to a swing-free condition at the end of the sequence of accelerations;

(c) determining a pendulum swing angle of the load corresponding with the ideal sequence of lifting carriage accelerations;

(d) determining a swing damping system control signal which makes the swing damping system follow the swing angle of the load;

(e) applying the lifting carriage speed change signal to the traversing motor; and (f) applying the swing damping system control signal to the swing damping equipment whereby the swing damping equipment allows the load to swing at the determined pendulum swing angle and damps only load swing that deviates from the determined pendulum swing angle.

2. The method according to claim 1, wherein said mechanical swing damping equipment includes swing damping ropes having adjustable length and said swing damping system control signal adjusts the length of the swing damping ropes.

3. The method according to claim 1, wherein said mechanical swing damping equipment includes a hydraulic damping system having hydraulic cylinders, and said swing damping system control signal adjusts damping induced by the hydraulic cylinders.

4. The method according to claim 1, wherein said mechanical swing damping equipment includes an electromechanical damping system having electromechanical actuators and said swing damping system control signal adjusts damping induced by the electromechanical actuators.

5. The method according to claim 1, wherein said mechanical swing damping equipment is mounted on a pivoting beam supported by said lifting carriage, an actuator is attached between the beam and the lifting carriage, and the beam is actively pivoted by motion of the actuator, and said swing damping system control signal adjusts displacement of the actuator.

6. The method according to claim 1, wherein said step (a) includes the step of:

(a1) determining a length of the hoisting rope and calculating a load condition period therefrom.

7. The method according to claim 1, wherein said step (a) includes the step of:

(a1) measuring an angle of deflection of the load and an angular velocity.

8. The method according to claim 1, wherein said crane has at least two separate parallel tracks with said lifting carriage running on one of the tracks, the crane having a movable control cabin running on another of the tracks, the control cabin having a device for moving the control cabin, and the control cabin having a location along said tracks relative to said load, the method further comprising the steps of:

(g) determining a cabin control signal which makes the cabin movement follow the determined pendulum swing angle of the load; and (h) applying the cabin control signal to the device for moving the cabin so that the relative location of the control cabin and said load along the tracks is maintained essentially unchanged.

9. A method for controlling the movement of an overhead crane, the crane having at least two separate parallel tracks, a movable lifting carriage running on one of the tracks, a traversing motor for moving the lifting carriage along the track, a control system which controls the traversing motor based on at least one command signal representative of lifting carriage speed, at least one hoisting rope depending from the lifting carriage, a load attached to the at least one hoisting rope such that the load is suspended by and swings from the lifting carriage, the crane having a movable control cabin running on another of the tracks, the control cabin having a device for moving the control cabin, and the control cabin having a location along said tracks relative to said load, the method comprising the steps of:

(a) defining an ideal sequence of accelerations for moving the lifting carriage that will bring the load to a swing-free condition at the end of the sequence of accelerations;

(b) developing a lifting carriage speed change signal which will bring the load to a swing-free condition at the end of the sequence of accelerations;

(c) determining a pendulum swing angle of the load corresponding with the ideal sequence of lifting carriage accelerations;

(d) determining a cabin control signal which makes the cabin movement follow the determined pendulum swing angle of the load;

(e) applying the lifting carriage speed change signal to the traversing motor; and (f) applying the cabin control signal to the device for moving the cabin so that the relative location of the control cabin and said load along the tracks is maintained essentially unchanged.

10. A method for controlling the movement of an overhead crane, the crane having at least at least two separate parallel tracks, a movable lifting carriage running on least one of the tracks, a traversing motor for moving the lifting carriage along the track, a control system which controls the traversing motor based on at least one command signal representative of lifting carriage speed, at least one hoisting rope depending from the lifting carriage, a load attached to the at least one hoisting rope such that the load is suspended by and swings from the lifting carriage, the crane having a movable control cabin running on another of the tracks, the control cabin having a device for moving the control cabin, the control cabin having a location along said tracks relative to said load, the crane also having mechanical swing damping equipment, and a control system which controls the mechanical swing damping equipment, the method comprising the steps of:

(a) defining an ideal sequence of accelerations for moving the lifting carriage that will bring the load to a swing-free condition at the end of the sequence of accelerations;

(b) developing a lifting carriage speed change signal which will bring the load to a swing-free condition at the end of the sequence of accelerations;

(c) determining a pendulum swing angle of the load corresponding with the ideal sequence of lifting carriage accelerations;

(d) determining a swing damping system control signal which makes the swing damping system follow the swing angle of the load;

(e) applying the lifting carriage speed change signal to the traversing motor;

(f) applying the swing damping system control signal to the swing damping equipment whereby the swing damping equipment allows the load to swing at the determined pendulum swing angle and damps only load swing that deviates from the determined pendulum swing angle;

(g) determining a cabin control signal which makes the cabin movement follow the determined pendulum swing angle of the load; and (h) applying the cabin control signal to the device for moving the cabin so that the relative location of the control cabin and said load along the tracks is maintained essentially unchanged.

* * * * *